United States Patent [19]

Temple

[11] 3,964,589

[45] June 22, 1976

[54] VENDING MACHINE COIN CHANGER

[76] Inventor: Roderick R. Temple, 2220 Jessie Ave., Sparks, Nev. 89431

[22] Filed: Apr. 17, 1973

[21] Appl. No.: 352,085

[52] U.S. Cl. ..... 194/10
[51] Int. Cl.[2] ..... G07F 11/02
[58] Field of Search ..... 194/10, 2, 102; 133/2, 133/3 C

[56] References Cited

UNITED STATES PATENTS 866,763 9/1907 Yocum ..... 133/3 C 3,237,745 3/1966 Gerhart et al. ..... 194/10

*Primary Examiner*—Stanley H. Tollberg
*Attorney, Agent, or Firm*—Oblon, Fisher, Spivak, McClelland & Maier

[57] ABSTRACT

Disclosed herein is a money changer to be used in combination with a machine having a pay circuit such as a vending machine. The changer comprises means for receiving the money to be changed, means for detecting the receipt of the money, and means responsive to the detecting means for activating the pay circuit to pay the required change.

6 Claims, 5 Drawing Figures

VENDING MACHINE COIN CHANGER

The present invention relates to a coin changer.

One problem with coin changers has been that the coins in the reservoir are used for change more quickly than service personnel can replenish the supply. Of course, the reservoir could be made larger but this creates problems with respect to practical limitations of size placed upon a coin changer. In addition, a coin changer with a rather large dollar value in change provides an unusually attractive target for theft.

It is therefore an object of the present invention to provide a coin changer of increased capacity which is not subject to the above noted disadvantages.

It is a further object of the invention to provide a coin changer which is simple in construction and simple in operation.

It is still a further object of the invention to provide a coin changer for use in a casino which has the capability of eliminating the necessity for the presence of change personnel on the floor of the casino.

Other objects will appear hereinafter.

These and other objects of the invention are achieved by associating the coin changer with a vending machine so that the capacity of the changer may be enlarged to include the coins present within the vending machine. Thus, a partially closed circuit system is set up wherein many of the coins discharged as change by using the changer are played in the vending machine and become part of the coin changer reservoir to be discharged as change and again played in the vending machine.

A means by which these and other objects are accomplished, and the manner of their accomplishment will readily be understood in the following specification upon reference to the accompanying drawings, in which.

Figure 1:
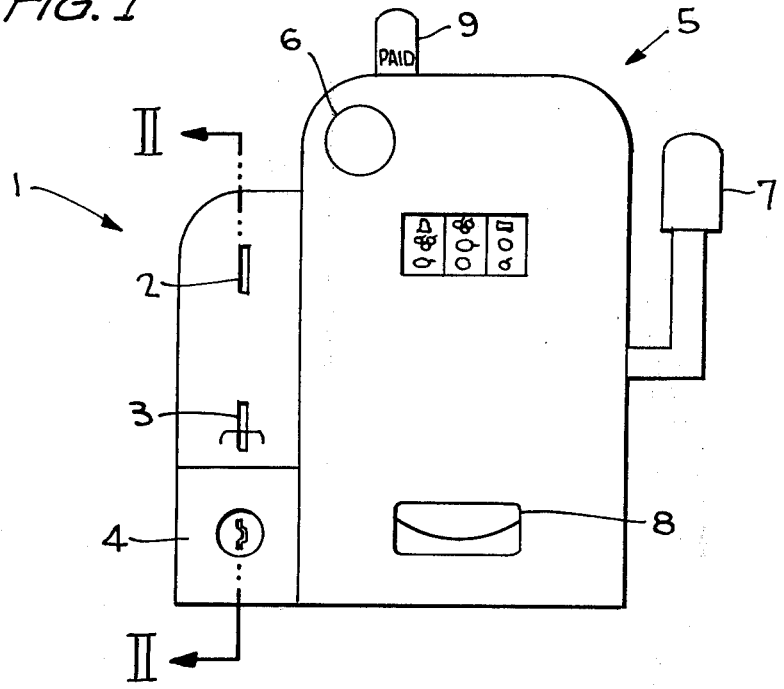
FIG. 1 is a front elevation of a coin changer attached to and able to use the coins within a vending machine.

Referring now to the drawings in which the various parts are designated by numerals:

Coin changer 1 is shown attached to vending machine 5 in FIG. 1. The coin changer as shown in FIG. 1 consists of a coin acceptance slot 2, a reject coin holder 3 and a coin box 4. The vending machine 5 is generally shown and includes a vending machine coin acceptance slot 6, a vending machine handle 7, a vending machine hopper 8 where coins exit from the vending machine, and a customer paid light 9 which is illuminated after money is discharged into the vending machine hopper 8.

Figure 2:
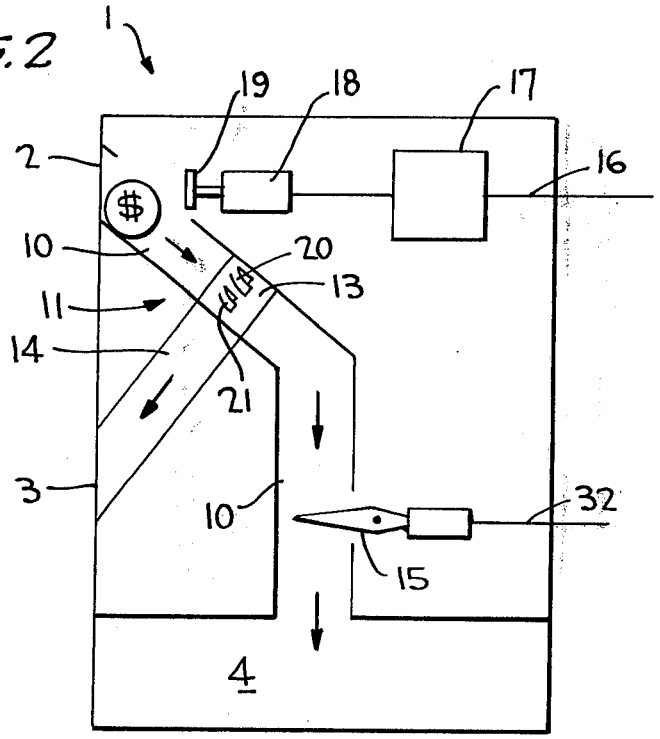
FIG. 2 is a vertical sectional elevation taken along the line II—II of the coin changer in FIG. 1.

The internal structure of the coin changer is best illustrated in FIG. 2. Coin changer 1 includes a coin acceptance slot 2 into which coins are inserted and a coin chute 10 down which the coins pass. As a coin passes down coin chute 10, it passes through a coin separator consisting of fingers 20 and 21 (shown in greater detail in FIG. 3 and whose operation will be explained hereinafter). If the coin is acceptable it will continue down coin chute 10 to coin box 4. If the coin is not acceptable because of its small size, it will be pushed by fingers 20 and 21 through reject coin opening 13 and down reject coin chute 14 by gravity to reject coin holder 3. As an acceptable coin passes down chute 10, it will strike and trip acceptance switch 15. The tripping of acceptance switch 15 causes a signal to be sent over line 32 of the pay circuit (not shown) in the vending machine which causes a predetermined number of coins to be discharged in the vending machine hopper 8.

Acceptance switch 15 is momentarily deflected by an acceptable coin and then returns to its normal position. If a coin jam-up prevents return to its normal position, acceptance switch 15 will not cause generation of a signal over line 32.

The activation of the pay circuit causes the generation of a signal over input line 16. Input line 16 is connected to lockout circuit 17 which is connected to solenoid 18 which controls lockout arm 19 which is operable to block coin slot 2 until the circuitry of the vending machine is reset to discharge coins upon the receipt of a signal over line 32. This is important because the circuitry of the vending machine to which the changer is attached may prevent the further discharge of coins into hopper 8 until the circuitry is reset by the insertion of a coin into slot 6 and the physical movement of handle 7. More specifically, a signal over input line 16 interrupts lockout circuit 17, releasing solenoid 18 and permitting spring biased lockout arm 19 to block coin slot 2 to prevent the further deposit of coins in coin changer 1.

Figure 3A:
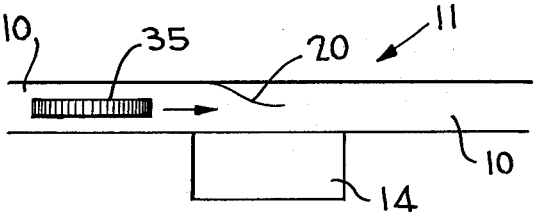
FIGS. 3A and 3B are top and side views, respectively, in partial cross-section, of a coin separator used in the coin changer of the invention.
Figure 3B:
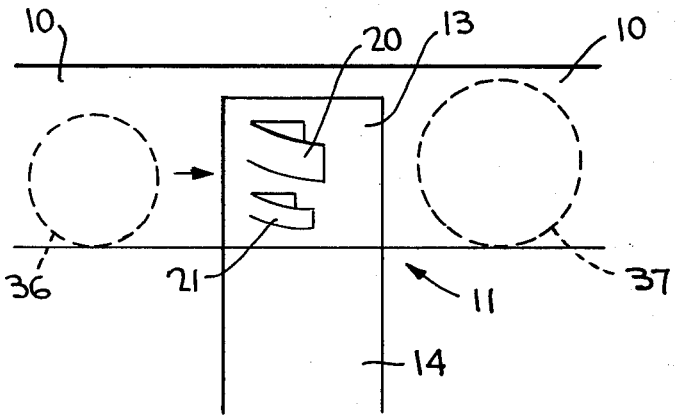

Coin separator 11 and its operation are best illustrated in FIGS. 3A and 3B. As coin 35 moves down chute 10, it encounters fingers 20 and 21 which reduce the momentum of the coin and cause it to be tipped toward reject coin opening 13. If the coin is undersized, it will be pushed through opening 13 and down coin chute 14 to reject coin holder 3. If the coin is of acceptable size, it will not fit through opening 13 and will continue to pass down coin chute 10. In the specific embodiment shown, the reject coin opening 13 is of such size that dollar coins are too large to pass therethrough. This is best illustrated in FIG. 3B which includes half-dollar coin 36 and dollar coin 37. As shown in FIG. 3B, half-dollar coin 36 is small enough to fit through opening 13 whereas dollar coin 37 is not. The function of upper finger 20 is to tip coins the size of a quarter and larger while the purpose of lower finger 21 is to tip coins smaller than a quarter.

Figure 4:
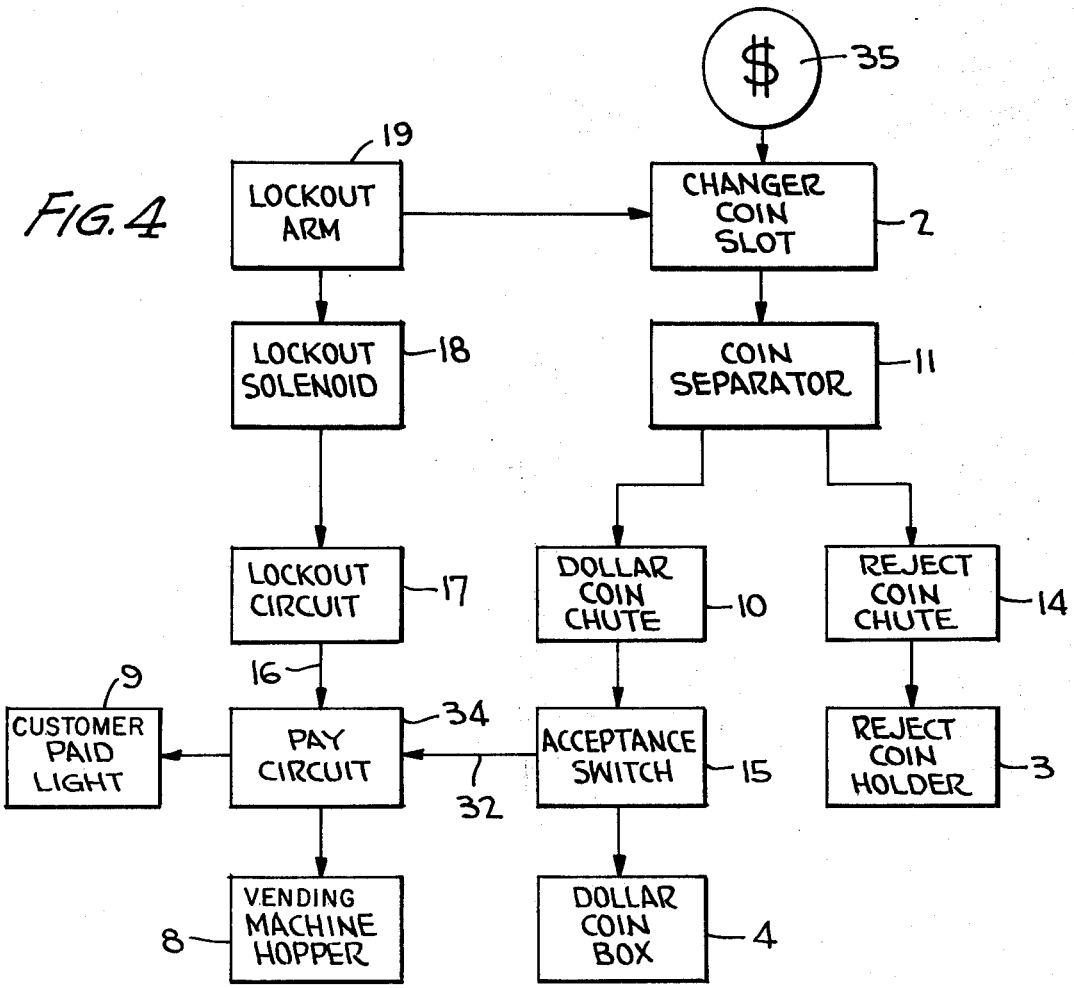
FIG. 4 illustrates the interaction between the circuitry and apparatus of the invention.

The operation of the circuitry and apparatus of the present invention can best be seen in FIG. 4. A coin 35 is inserted into the changer coin slot 2 from whence it passes to coin separator 11 which is connected to reject coin chute 14. If the coin is smaller than a silver dollar, it will pass down reject coin chute 14 and into reject coin holder 3. If the coin is a silver dollar, it will pass down the dollar coin chute 10 where it will trip acceptance switch 15 and continue on to the dollar coin box 4. The acceptance switch 15 transmits a signal over line 32 to pay circuit 34 in the vending machine. The pay circuit causes the predetermined amount of the change to be discharged in vending machine hopper 8 and the illumination of customer paid light 9. Activation of pay circuit 34 causes transmission of a signal over line 16 which interrupts lockout circuit 17 deenergizing solenoid 18 permitting spring biased lockout arm 19 to block changer coin slot 2. This will prevent the insertion of another coin into the coin changer until pay circuit 34 has been reset.

With reference to FIGS. 1 and 4, the pay circuit in a conventional vending machine such as vending machine 5 is reset by inserting a coin in vending machine coin slot 6 and pulling vending machine handle 7 to play the vending machine. This resets pay circuit 34 and turns off customer paid light 9. This also energizes lockout solenoid 18 through lockout circuit 17. Energization of solenoid 18 causes lockout arm 19 to be withdrawn and thus unblock changer coin slot 2. It should also be noted that the changer of the instant invention may not be operated immediately after vending machine 5 has discharged coins in response to an entry that activates pay circuit 34. In this instance, it is again necessary that pay circuit 34 be activated by an entry in vending machine 5 which does not activate pay circuit 34.

While I have shown and described the preferred embodiment in accordance with the present invention, it will be readily understood that the same is susceptible to numerous changes and modifications without departing from the scope of the present invention as will be apparent to one of ordinary skill in the art.

I claim:

1. A vending machine having a pay circuit for discharging coins and a coin changer therefor comprising:

a vending machine comprising:

a first coin acceptance slot for accepting only a coin of a predetermined first denomination, a vending machine hopper, a pay circuit for simultaneously discharging a plurality of coins of said predetermined first demonination into said vending machine hopper, a coin changer connected to said vending machine comprising:

a second coin acceptance slot for accepting a coin to be changed of a second predetermined denomination, a coin reservoir, means for conveying said coin to be changed from said second coin acceptance slot to said coin reservoir, means for detecting the passage of said coin to be changed through said conveying means and for transmitting a pay signal to said pay circuit of said vending machine to discharge into said vending machine hopper coins of said first predetermined denomination in return for said coin to be changed of said second predetermined denomination.

2. A coin changer in accordance with claim 1 further including means to detect whether a coin to be changed is of the required size and means to reject the coin if it is not.

3. A coin changer in accordance with claim 2 further including finger-means to direct a coin to be changed towards an opening of predetermined size so that only coins larger than the opening are permitted to pass thereby without being caused to fall into the opening.

4. A coin changer in accordance with claim 3 wherein the finger-means comprise a first finger to direct towards the opening coins smaller than a quarter and a second finger to direct towards the opening all other coins.

5. A coin changer in accordance with claim 4 wherein the means for conveying the coin from said second coin acceptance slot to said coin reservoir comprises a chute.

6. A coin changer in accordance with claim 5 wherein said finger means are disposed to project into said chute so that a coin strikes said finger means as it traverses said chute.

* * * * *